US006201520B1

(12) United States Patent
Iketsu et al.

(10) Patent No.: US 6,201,520 B1
(45) Date of Patent: Mar. 13, 2001

(54) DRIVING ORGANIC THIN-FILM EL DISPLAY BY FIRST ZERO BIASING BY SHORT CIRCUITING ALL PIXELS AND THEN FORWARD BIASING SELECTED PIXELS AND REVERSE BIASING NONSELECTED PIXELS TO PREVENT CROSSTALK

(75) Inventors: Yuichi Iketsu; Yuji Kondo, both of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/154,510

(22) Filed: Sep. 16, 1998

(30) Foreign Application Priority Data

Sep. 16, 1997 (JP) ..... 9-250609

(51) Int. Cl.[7] ..... G09G 3/30; G09G 3/10
(52) U.S. Cl. ..... 345/76; 315/169.3
(58) Field of Search ..... 345/76–81, 45, 345/55, 58, 209, 204, 205, 206, 208; 315/169.3

(56) References Cited

U.S. PATENT DOCUMENTS 4,652,872 * 3/1987 Fujita ..... 345/78
4,864,182 * 9/1989 Fujioka et al. ..... 315/169.3
4,999,618 * 3/1991 Inada et al. ..... 345/79
5,006,838 * 4/1991 Fujioka et al. ..... 345/79
5,075,596 * 12/1991 Young et al. ..... 345/76
5,719,589 * 2/1998 Norman et al. ..... 345/209
5,781,168 * 7/1998 Osada et al. ..... 345/76
5,828,181 * 10/1998 Okuda ..... 345/76
5,841,412 * 11/1998 Ebihara ..... 345/58
5,844,368 * 12/1998 Okuda et al. ..... 315/169.3
5,929,845 * 7/1999 Wei et al. ..... 345/156
5,973,456 * 10/1999 Osada et al. ..... 315/169.3
6,014,119 * 1/2000 Staring et al. ..... 345/77

FOREIGN PATENT DOCUMENTS 6-301355 10/1994 (JP) .
8-315981 11/1996 (JP) .
9-204985 8/1997 (JP) .
9-232074 9/1997 (JP) .

* cited by examiner

*Primary Examiner*—Steven J. Saras
*Assistant Examiner*—Paul A. Bell
(74) *Attorney, Agent, or Firm*—Young & Thompson

(57) ABSTRACT

When a forward bias is applied between a selected unit electrode of scanning electrodes and a selected unit electrode of data electrodes to cause a selected pixel concerning both of the selected unit electrodes to emit light, and a reverse bias is applied between nonselected unit electrodes of the scanning electrodes and nonselected unit electrodes of the data electrodes, thereby preventing crosstalk caused by a semi-excited state of the nonselected pixels, all of the scanning electrodes and all of the data electrodes are short-circuited once, immediately before a predetermined unit electrode of the data electrode, which should be selected in accordance with selection of each of the unit electrodes of the scanning electrodes, is selected, to set all of the pixels at a zero bias.

4 Claims, 11 Drawing Sheets

DRIVING ORGANIC THIN-FILM EL DISPLAY BY FIRST ZERO BIASING BY SHORT CIRCUITING ALL PIXELS AND THEN FORWARD BIASING SELECTED PIXELS AND REVERSE BIASING NONSELECTED PIXELS TO PREVENT CROSSTALK

BACKGROUND OF THE INVENTION

1. Field of the Invention

The present invention relates to a method of driving an organic thin-film EL device which has an organic thin-film EL structure and in which pixels are arranged in a matrix.

2. Description of the Prior Art

An example of a conventional organic thin-film EL display device is disclosed in, e.g., Japanese Unexamined Patent Publication No. 6-301355.

FIG. 1 shows an equivalent circuit of matrix driving of organic thin-film EL elements disclosed in Japanese Unexamined Patent Publication No. 6-301355.

In this reference, the organic multilayered thin film including an emission layer is sandwiched between scanning electrodes $X_1$ to $X_n$ serving as cathodes and data electrodes $Y_1$ to $Y_m$ serving as anodes. Pixels each having an organic thin-film EL structure are arranged in a matrix. The scanning electrodes $X_1$ to $X_n$ are scanned, i.e., transistors $\mathbf{7}_1$ to $\mathbf{7}_n$ are sequentially turned on one by one to sequentially select the unit electrodes of the scanning electrodes $X_1$ to $X_n$ and to set them at the ground potential. In accordance with this, a current is supplied to a predetermined unit electrode which should be selected from the data electrodes $Y_1$ to $Y_m$ in accordance with display data. In other words, a predetermined transistor and a predetermined current supply means which should be selected from transistors $\mathbf{11}_1$ to $\mathbf{11}_m$ and from current supply means $\mathbf{10}_1$ to $\mathbf{10}_m$, respectively, in accordance with the display data, are turned off and set in an operative state, respectively. Hence, a forward bias is applied to selected pixels, concerning the selected unit electrodes of both the scanning electrodes and data electrodes, to cause them to emit light. The nonselected unit electrodes of the scanning electrodes $X_1$ to $X_n$ are set at a power supply potential $V_B$ by pull-up means $R_c$ comprising resistors and the like. The nonselected unit electrodes of the data electrodes $Y_1$ to $Y_m$ are set at the ground potential by pull-down means $R_e$ comprising resistors and the like. A reverse bias is applied to the nonselected pixels concerning the nonselected unit electrodes of both the scanning electrodes and data electrodes, and a zero bias or a bias equal to or lower than an emission threshold is applied to the nonselected pixels concerning the selected and nonselected unit electrodes. In this manner, crosstalk caused by the semi-excited state of the nonselected pixels is prevented.

In the prior art shown in FIG. 1, for the sake of simplicity, each of the current supply means $\mathbf{10}_1$ to $\mathbf{10}_m$ is constituted by one transistor. In fact, a higher-precision constant-current circuit is often employed as the current supply means so that a difference in luminance does not occur among pixels due to a voltage drop caused by the interconnection resistance of the scanning electrodes and data electrodes.

The problem of the conventional method of driving an organic thin-film EL display device described above is that the response speed from selection of a pixel to emission of the selected pixel is low.

The reason for this will be described hereinafter.

FIG. 2 is an equivalent circuit diagram of a drive circuit concerning an organic thin-film EL display device and a conventional driving method.

Scanning electrodes $X_1$ to $X_n$ are connected, through switches $\mathbf{7}_1$ to $\mathbf{7}_n$, to ground when they are selected and to a power supply voltage $V_B$ when they are not selected. Data electrodes $Y_1$ to $Y_m$ are connected, through switches $\mathbf{11}_1$ to $\mathbf{11}_m$, to corresponding current supply means $\mathbf{10}_1$ to $\mathbf{10}_m$ when they are selected and to ground when they are not selected. Each pixel D(x:1 to n, y:1 to m) having an organic thin-film EL structure is indicated by a diode and a parallel capacitance. As an example, a case will be described wherein a certain unit electrode $X_i$ of the scanning electrodes is selected, and in accordance with this a certain unit electrode $Y_j$ of the data electrodes is selected, so that a pixel D(i, j) concerning the both unit electrodes is caused to emit light.

FIG. 3 is a timing chart showing the conventional method of driving an organic thin-film EL display device. FIG. 3 shows the switching operations of the switches $\mathbf{7}_{i-1}$, $\mathbf{7}_i$, $\mathbf{7}_{i+1}$, and $\mathbf{11}_j$ of FIG. 2 and a change over time of the potential of each of the unit electrode $X_i$ of the scanning electrodes and of the unit electrode $Y_j$ of the data electrodes caused by these switching operations.

Immediately before a time period $t_i$ during which the unit electrode $X_i$ of the scanning electrodes is selected by the switch $\mathbf{7}_i$ and set at the ground potential, the unit electrode $X_{i-1}$ of the scanning electrodes is selected by the switch $\mathbf{7}_{i-1}$ and set at the ground potential, or all the scanning electrodes $X_1$ to $X_n$ are in the nonselected state. Hence, at least the unit electrodes of the (n−1) scanning electrodes are at the power supply potential $V_B$. At this time, if the unit electrode $Y_j$ of the data electrodes is not selected by the switch $\mathbf{11}_j$, as indicated by a solid line, the unit electrode $Y_j$ of the data electrodes is at the ground potential, so that a reverse bias is applied to at least (n−1) pixels of pixels D(1, j) to D(n, j) concerning the scanning electrodes $X_1$ and $X_n$ and the unit electrode $Y_j$ of the data electrodes, and that the respective parallel capacitances of these (n−1) pixels are charged in the reverse bias direction. Thereafter, during the time period $t_i$, the unit electrode $X_i$ of the scanning electrodes is selected by the switch $\mathbf{7}_i$, and the unit electrode $Y_j$ of the data electrodes is selected by the switch $\mathbf{11}_j$. Then, the potential of the unit electrode $X_i$ of the scanning electrodes is quickly set at the ground potential. However, the current from the current supply means $\mathbf{10}_i$ connected to the unit electrode $Y_j$ of the data electrodes through the switch $\mathbf{11}_j$ is used to cancel the storage capacitance in the reverse bias direction of at least (n−1) pixels described above. Hence, the potential of the unit electrode $Y_j$ of the data electrodes does not increase at once, and accordingly a delay time $t_d$ occurs until a forward bias is applied to the pixel D(i, j) to cause it to emit light. In particular, if the current supply means $\mathbf{10}_j$ is a constant-current circuit, the potential of the unit electrode $Y_j$ of the data electrodes increases only as a linear function of time elapsed since the unit electrode $Y_j$ is selected. As a result, the delay time $t_d$ described above increases further.

SUMMARY OF THE INVENTION

The present invention has been made in consideration of the above problems in the prior art, and has as its object to provide a method of driving an organic thin-film EL display device wherein, when a forward bias is applied between a selected unit electrode of scanning electrodes and a selected unit electrode of data electrodes to cause a selected pixel concerning the both selected unit electrodes to emit light, and a reverse bias is applied between the nonselected unit electrodes of the scanning electrodes and the nonselected unit electrodes of the data electrodes, thereby preventing crosstalk caused by a semi-excited state of the nonselected pixels, a large delay is not caused in emission of the selected pixel, and large-capacity display can be coped with.

In order to achieve the above object, according to the first aspect of the present invention, there is provided a method of driving an organic thin-film EL display device, wherein when a forward bias is applied between a selected unit electrode of scanning electrodes and a selected unit electrode of data electrodes to cause a selected pixel concerning both of the selected unit electrodes to emit light, and a reverse bias is applied between nonselected unit electrodes of the scanning electrodes and nonselected unit electrodes of the data electrodes, thereby preventing crosstalk caused by a semi-excited state of the nonselected pixels, all of the scanning electrodes and all of the data electrodes are short-circuited once, immediately before a predetermined unit electrode of the data electrode, which should be selected in accordance with selection of each of the unit electrodes of the scanning electrodes, is selected, to set all of the pixels at a zero bias.

According to the second aspect of the present invention, there is provided a method of driving an organic thin-film EL display device, wherein when a forward bias is applied between a selected unit electrode of scanning electrodes and a selected unit electrode of data electrodes to cause a selected pixel concerning both of the selected unit electrodes to emit light, and a reverse bias is applied between nonselected unit electrodes of the scanning electrodes and nonselected unit electrodes of the data electrodes, thereby preventing crosstalk caused by a semi-excited state of the nonselected pixels, all of the scanning electrodes and a predetermined unit electrode of the data electrodes are short-circuited once, immediately before the predetermined unit electrode of the data electrode, which should be selected in accordance with selection of each of the unit electrodes of the scanning electrodes, is selected, to set pixels concerning all of the scanning electrodes and the predetermined unit electrode of the data electrodes at a zero bias.

According to the third aspect of the present invention, there is provided a drive circuit for an organic thin-film EL display device, wherein when a forward bias is applied between a selected unit electrode of scanning electrodes and a selected unit electrode of data electrodes to cause a selected pixel concerning both of the selected unit electrodes to emit light, and a reverse bias is applied between nonselected unit electrodes of the scanning electrodes and nonselected unit electrodes of the data electrodes, thereby preventing crosstalk caused by a semi-excited state of the nonselected pixels, all of the scanning electrodes and all of the data electrodes are short-circuited once, immediately before a predetermined unit electrode of the data electrode, which should be selected in accordance with selection of each of the unit electrodes of the scanning electrodes, is selected, to set all of the pixels at a zero bias.

According to the fourth aspect of the present invention, there is provided a drive circuit for an organic thin-film EL display device, wherein when a forward bias is applied between a selected unit electrode of scanning electrodes and a selected unit electrode of data electrodes to cause a selected pixel concerning both of the selected unit electrodes to emit light, and a reverse bias is applied between nonselected unit electrodes of the scanning electrodes and nonselected unit electrodes of the data electrodes, thereby preventing crosstalk caused by a semi-excited state of the nonselected pixels, all of the scanning electrodes and a predetermined unit electrode of the data electrodes are short-circuited once, immediately before the predetermined unit electrode of the data electrode, which should be selected in accordance with selection of each of the unit electrodes of the scanning electrodes, is selected, to set pixels concerning all of the scanning electrodes and the predetermined unit electrode of the data electrodes at a zero bias.

As is apparent from the aspects described above, the effect of the present invention resides in that, even when a forward bias is applied between the selected unit electrode of the scanning electrodes and the selected unit electrode of the data electrodes to cause the selected pixel concerning both of the selected unit electrodes to emit light, and a reverse bias is applied between the nonselected unit electrodes of the scanning electrodes and the nonselected unit electrodes of the data electrodes, thereby preventing crosstalk caused by a semi-excited state of the nonselected pixels, a large delay does not occur in emission of the selected pixel.

The reason for this is as follows. All of the scanning electrodes and all of the data electrodes, or all of the scanning electrodes and the unit electrodes of a data electrode, which should be selected next, are short-circuited once, immediately before a predetermined unit electrode of the data electrode, which should be selected in accordance with selection of each of the unit electrodes of the scanning electrodes, is selected, to set all the pixels, or a pixel concerning the unit electrode of the data electrode, which should be selected next, at a zero bias. Therefore, a forward bias is quickly applied to the selected pixel without accompanying discharge of the storage capacitance of the pixel which has been reverse-biased immediately before the zero bias operation.

The above and many other objects, features and advantages of the present invention will become manifest to those skilled in the art upon making reference to the following detailed description and accompanying drawings in which preferred embodiments incorporating the principles of the present invention are shown by way of illustrative examples.

DETAILED DESCRIPTION OF THE PREFERRED EMBODIMENTS

Several preferred embodiments of the present invention will be described with reference to the accompanying drawings.

Figure 4:
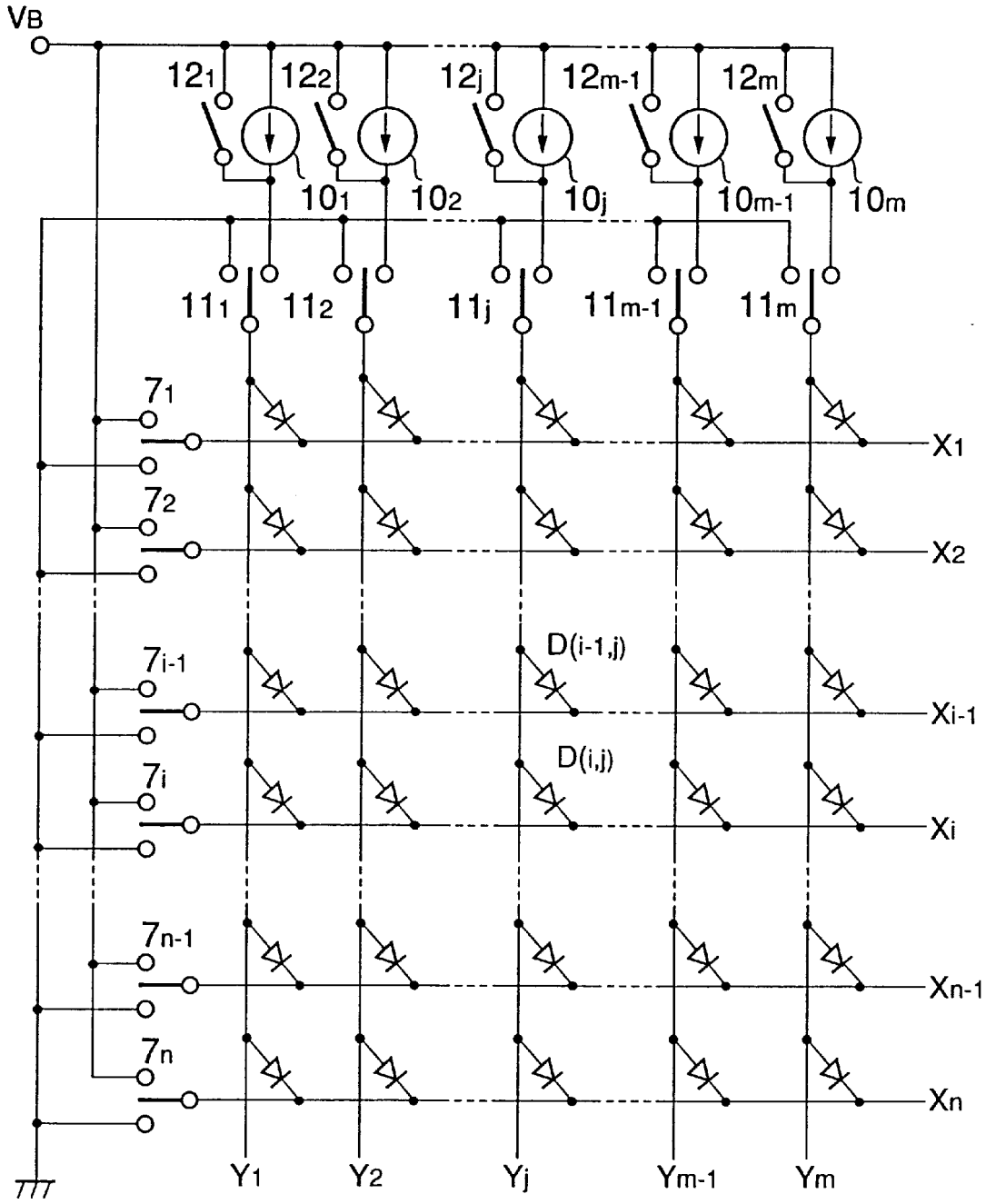
FIG. 4 is an equivalent circuit diagram of a drive circuit concerning an organic thin-film EL display device and a drive method according to the first embodiment of the present invention.

FIG. 4 is an equivalent circuit diagram of a drive circuit concerning an organic thin-film EL display device and a drive method according to the first embodiment of the present invention.

Scanning electrodes $X_1$ to $X_n$ are respectively connected to switches $\mathbf{7}_1$ to $\mathbf{7}_n$, so that they are are connected to ground when they are selected and to a power supply voltage $V_B$ when they are not selected.

Data electrodes $Y_1$ to $Y_m$ are respectively connected to switches $\mathbf{11}_1$ to $\mathbf{11}_m$, so that they are connected to the corresponding current supply means $\mathbf{10}_1$ to $\mathbf{10}_m$ when they are selected and to ground when they are not selected.

The respective current supply means $\mathbf{10}_1$ to $\mathbf{10}_m$ are connected in parallel to switches $\mathbf{12}_1$ to $\mathbf{12}_m$ that short-circuit them. As an example, a case will be described wherein a pixel D(i, j) is selected to emit light.

Figure 5:
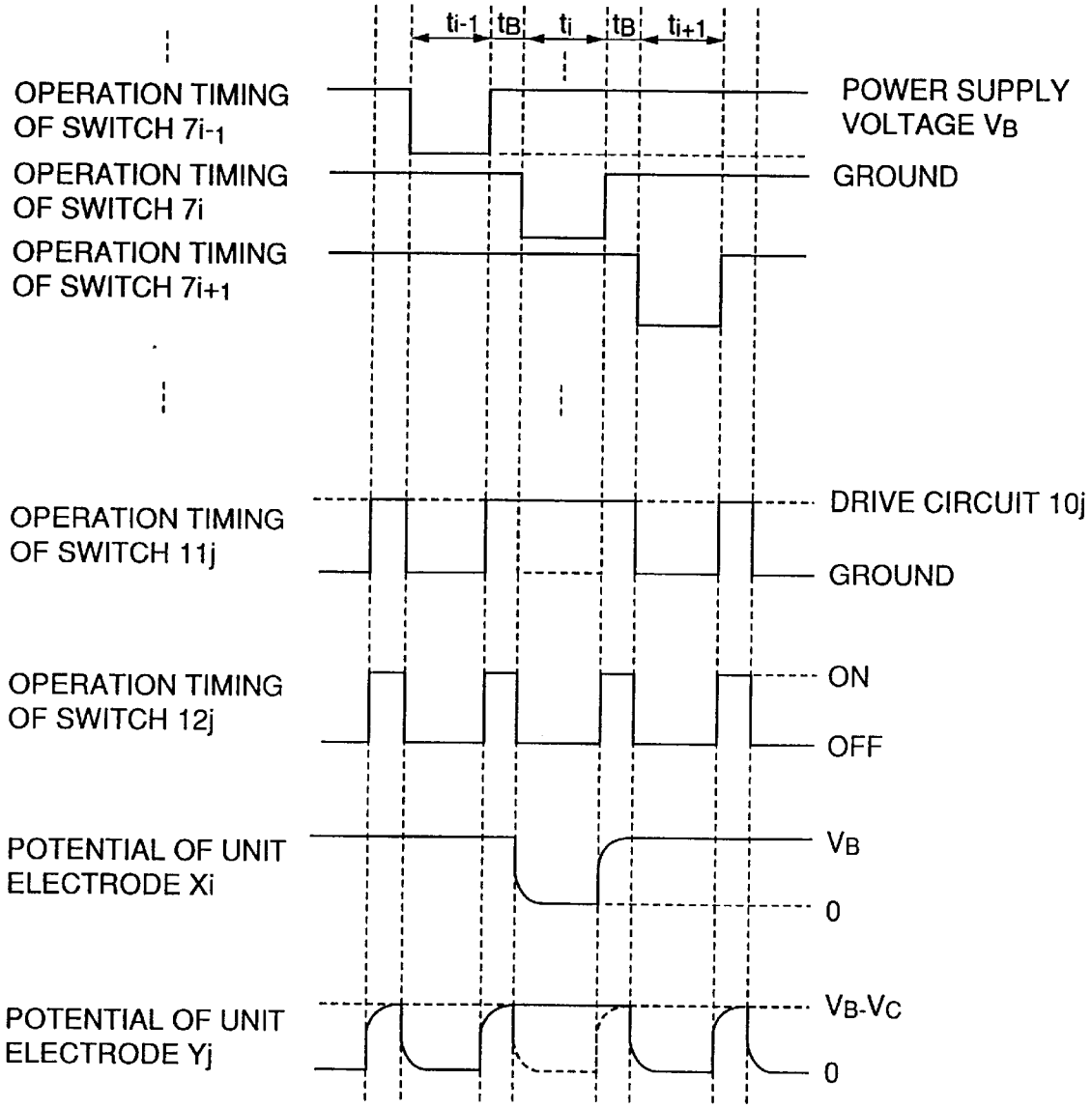
FIG. 5 is a timing chart showing the drive method of the drive circuit shown in FIG. 4.

FIG. 5 is a timing chart showing the drive method of the drive circuit shown in FIG. 4. FIG. 5 shows the switching operations of the switches $\mathbf{7}_{i-1}$, $\mathbf{7}_i$, $\mathbf{7}_{i+1}$, $\mathbf{11}_j$, and $\mathbf{12}_j$ shown in FIG. 4, and a change over time of the potential of a unit electrode $X_i$ of the scanning electrodes and of a unit electrode $Y_j$ of the data electrodes caused by the switching operations.

In a time period $t_{i-1}$ during which a unit electrode $X_{i-1}$ of the scanning electrodes is selected by the switch $\mathbf{7}_{i-1}$ and connected to ground, the switch $\mathbf{11}_j$ connects the unit electrode $Y_j$ of the data electrodes to either the current supply means $\mathbf{10}_j$ or ground in accordance with a display data. At this time, if the unit electrode $Y_j$ of the data electrodes is connected to ground, as indicated by solid lines, a zero bias is applied to a pixel D(i−1, j), and a reverse bias is applied to pixels D(1, j) to D(i−2, j), and pixels D(i, j) to D(n, j), to charge the parallel capacitances of these pixels in the reverse bias direction. Then, a time period $t_B$ follows during which the switches $\mathbf{7}_1$ to $\mathbf{7}_n$ connect all the scanning electrodes $X_1$ to $X_n$ to the power supply voltage $V_B$. In the time period $t_B$, the switches $\mathbf{11}_1$ to $\mathbf{11}_m$ connect all the data electrodes $Y_1$ to $Y_m$ to the corresponding current supply means $\mathbf{10}_1$ to $\mathbf{10}_m$. Simultaneously, the switches $\mathbf{12}_1$ to $\mathbf{12}_m$ are closed, and all the data electrodes $Y_1$ to $Y_m$ are short-circuited to all the scanning electrodes $X_1$ to $X_n$. Accordingly, the storage capacitances of the pixels that have been charged in the reverse bias direction in the time period $t_{i-1}$ are discharged quickly regardless of the current supply means $\mathbf{10}_j$, and all the pixels are zero-biased. Thereafter, during a time period $t_i$, when the unit electrode $X_i$ of the scanning electrodes is selected by a switch $\mathbf{7}_i$ and the switch $\mathbf{11}_j$ connects the unit electrode $Y_j$ of the data electrodes to the current supply means $\mathbf{10}_j$, the potential of the unit electrode $Y_j$ of the data electrodes increases immediately, and no delay occurs in emission of the pixel D(i, j).

Figure 6:
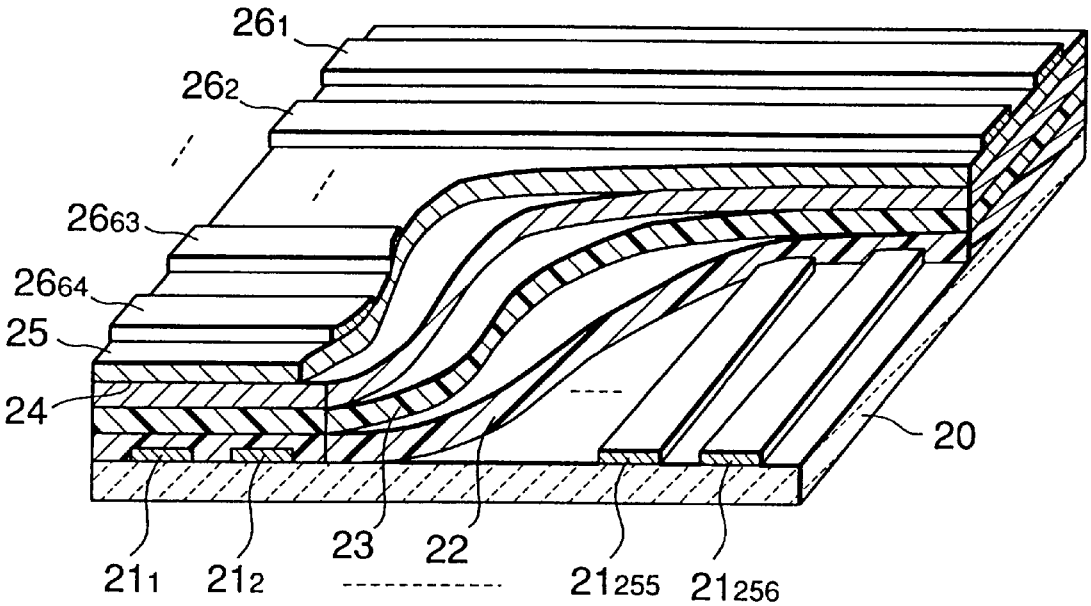
FIG. 6 shows the schematic arrangement of one embodiment of the organic thin-film EL display device.

FIG. 6 shows the schematic arrangement of one embodiment of the organic thin-film EL display device.

An ITO film having a thickness of 120 [nm] was formed on a glass substrate 20 by sputtering, and 256 transparent stripe electrodes $\mathbf{21}_1$ to $\mathbf{21}_{256}$ each having a width of 0.3 mm were formed on the ITO film with a pitch of 0.33 mm by photolithography. A hole injection layer 22, a hole transport layer 23, an emission layer 24, and an electron transport layer 25 each constituted by an organic thin film were formed on the stripe electrodes $\mathbf{21}_1$ to $\mathbf{21}_{256}$ by vacuum deposition, and 300-[nm] thick stripe electrodes $\mathbf{26}_1$ to $\mathbf{26}_{64}$ made of an Al—Li alloy were formed on the resultant structure by vacuum deposition to perpendicularly intersect the transparent stripe electrodes. This organic thin-film EL display device was driven by the prior art by using the stripe electrodes $\mathbf{26}_1$ to $\mathbf{26}_{64}$ as the scanning electrodes. The turn-on delay time of a selected pixel was 150 to 200 [μs].

Figure 7:
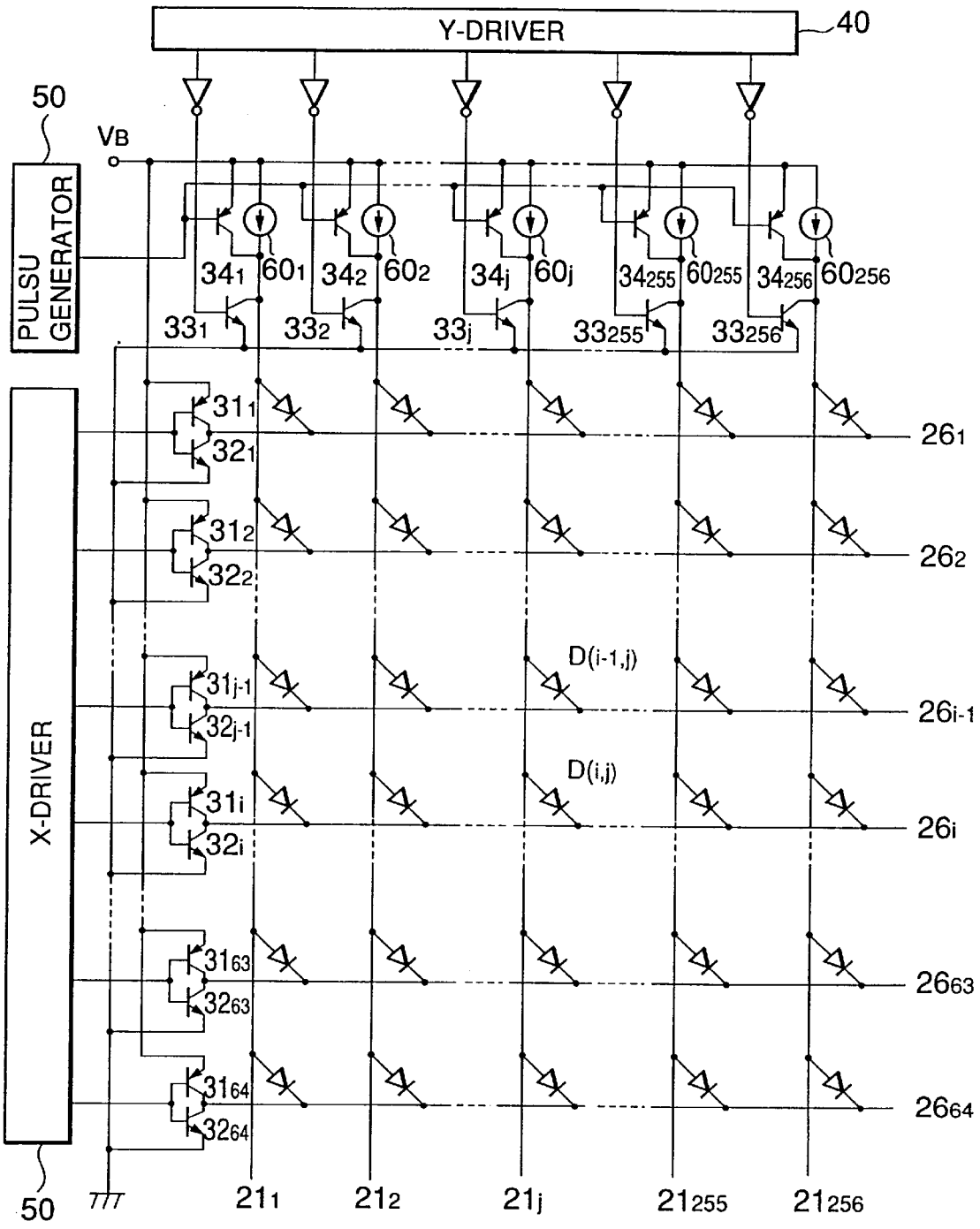
FIG. 7 shows the equivalent circuit of the organic thin-film EL display device and a drive circuit that realizes one embodiment of the present invention.
Figure 8:
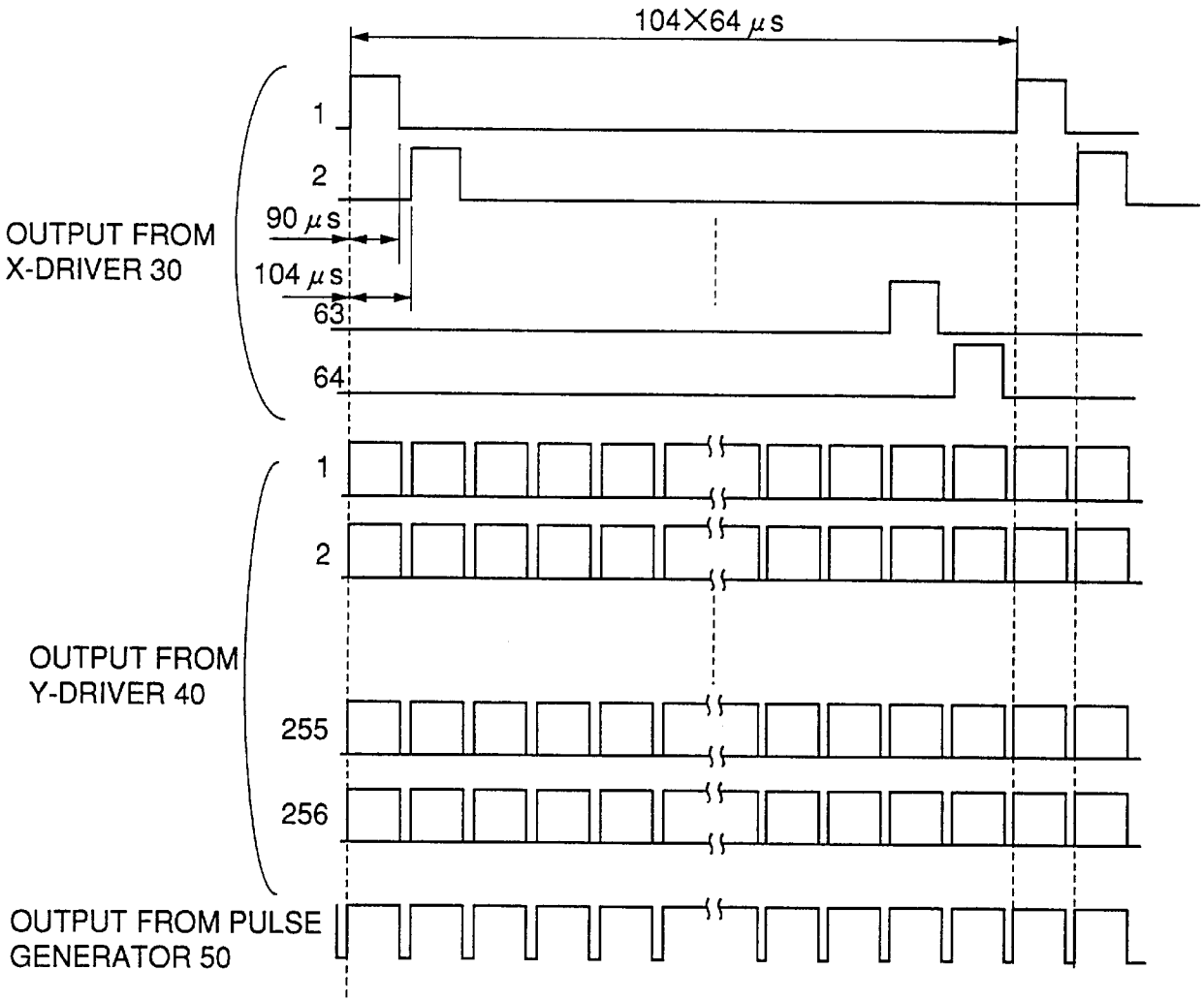
FIG. 8 is a timing chart of pulses that control the drive circuit shown in FIG. 7.

FIG. 7 shows the equivalent circuit of the organic thin-film EL display device and a drive circuit that realizes one embodiment of the present invention. FIG. 8 is a timing chart of pulses that control the drive circuit shown in FIG. 7.

An X-driver 30 is a 64-stage shift resistor that generates a pulse having a width of 90 [μs] at a shift interval of 104 [μs]. Upon reception of this shift pulse, transistors $\mathbf{31}_1$ to $\mathbf{31}_{64}$ and transistors $\mathbf{32}_1$ to $\mathbf{32}_{64}$ sequentially switch the stripe electrodes $\mathbf{26}_1$ to $\mathbf{26}_{64}$. More specifically, when the ith shift pulse is input, a transistor $\mathbf{31}_i$ is turned on and a transistor $\mathbf{32}_i$ is turned off to ground a stripe electrode $\mathbf{26}_i$. Other stripe electrodes $\mathbf{26}_1$ to $\mathbf{26}_{i-1}$ and $\mathbf{26}_{i+1}$ to $\mathbf{26}_{64}$ are connected to the power supply voltage $V_B$ since the transistors $\mathbf{31}_1$ to $\mathbf{31}_{i-1}$ and $\mathbf{31}_{i+1}$ to $\mathbf{31}_{64}$ are turned on and the transistors $\mathbf{32}_1$ to $\mathbf{32}_{i-1}$ and $\mathbf{32}_{i+1}$ to $\mathbf{32}_{64}$ are turned off.

In synchronism with the rise of the shift pulse of the X-driver 30, a Y-driver 40 generates 256 parallel pulses in accordance with display data, and the inverted pulses of these parallel pulses are input to the bases of transistors $\mathbf{33}_1$ to $\mathbf{33}_{256}$, respectively. For example, when the base of a transistor $\mathbf{33}_j$ goes low, a transistor $\mathbf{33}_j$ is turned off. A current from a current supply means $\mathbf{60}_j$ is supplied to the transparent stripe electrode $\mathbf{21}_j$. When the base of the transistor $\mathbf{33}_j$ goes high, the transistor $\mathbf{33}_j$ is turned on to ground the transparent stripe electrode $\mathbf{21}_j$. A pulse generator 50 generates a pulse that falls and rises in synchronism with the fall and rise, respectively, of any shift pulse from the X-driver 30. The pulse from the pulse generator 50 is input to the bases of transistors $\mathbf{34}_1$ to $\mathbf{34}_{256}$ simultaneously. In a time period $t_B$ during which this pulse is kept low, all the transistors $\mathbf{31}_1$ to $\mathbf{31}_{64}$ are turned off, all the transistors 32, to $\mathbf{32}_{64}$ are turned off, all the transistors $\mathbf{33}_1$ to $\mathbf{33}_{256}$ are turned off, and all the transistors $\mathbf{34}_1$ to $\mathbf{34}_{256}$ are turned on. Hence, the potential of the transparent stripe electrodes $\mathbf{21}_1$ to $\mathbf{21}_{256}$ and the potential of the stripe electrodes $\mathbf{26}_1$ to $\mathbf{26}_{64}$ are all set at the power supply voltage $V_B$, and all the organic thin-film EL pixels are set in the zero-bias state.

Figure 9:
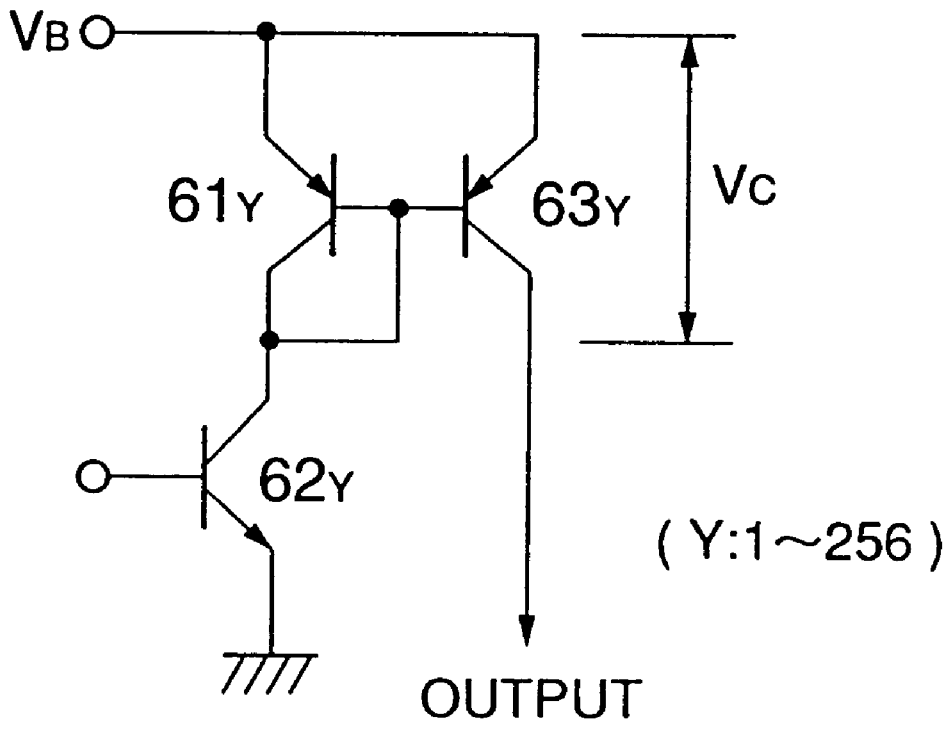
FIG. 9 is a circuit diagram constituting one of current supply means.

FIG. 9 is a circuit diagram constituting one of current supply means $\mathbf{60}_1$ to $\mathbf{60}_{256}$.

The turn-on delay time of a selected pixel in this embodiment was equal to or less than 5 [μs].

Figure 1:
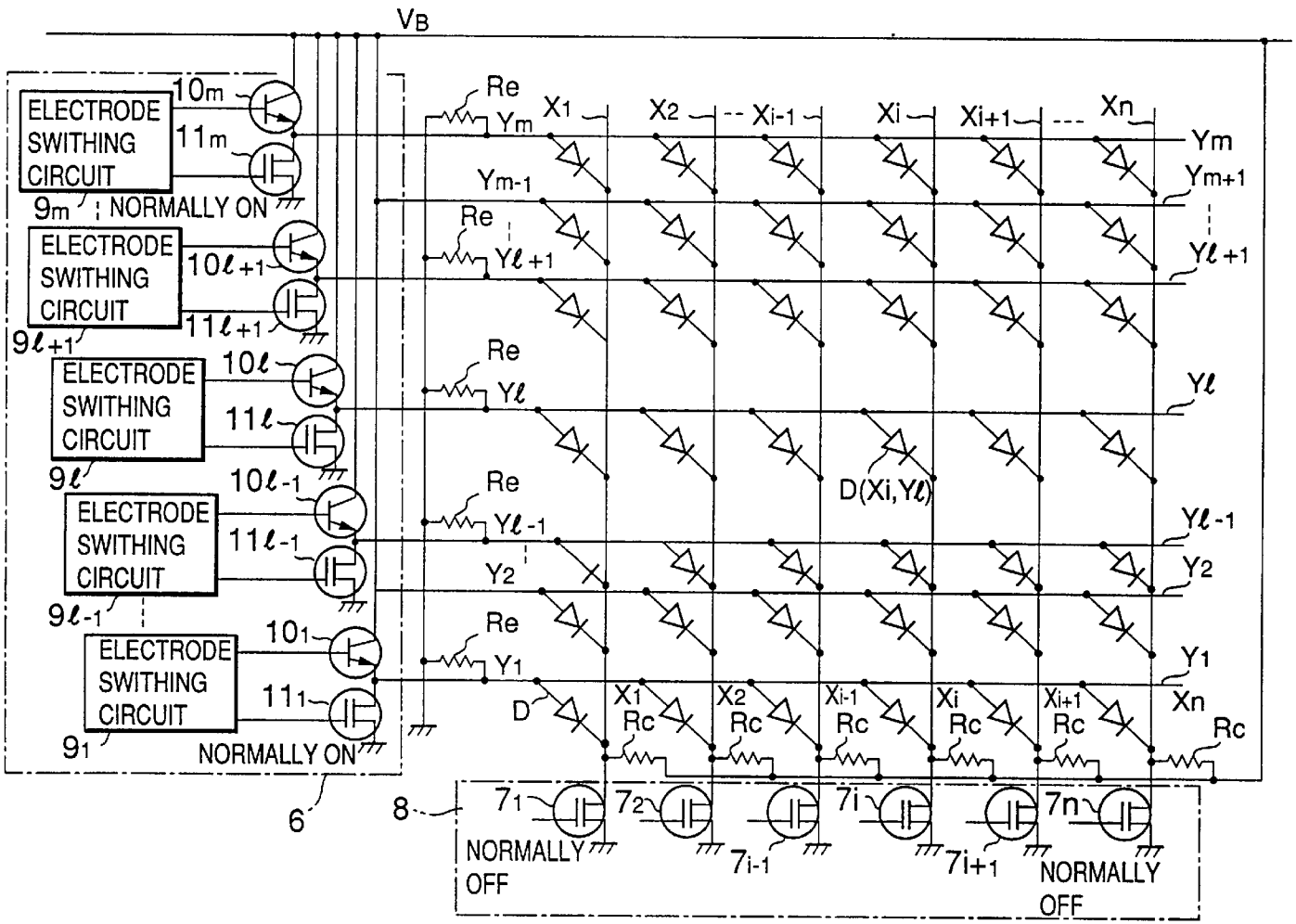
FIG.1 PRIOR ART
FIG. 1 shows an equivalent circuit of matrix driving of organic thin-film EL elements disclosed in Japanese Unexamined Patent Publication No. 6-301355.
Figure 2:
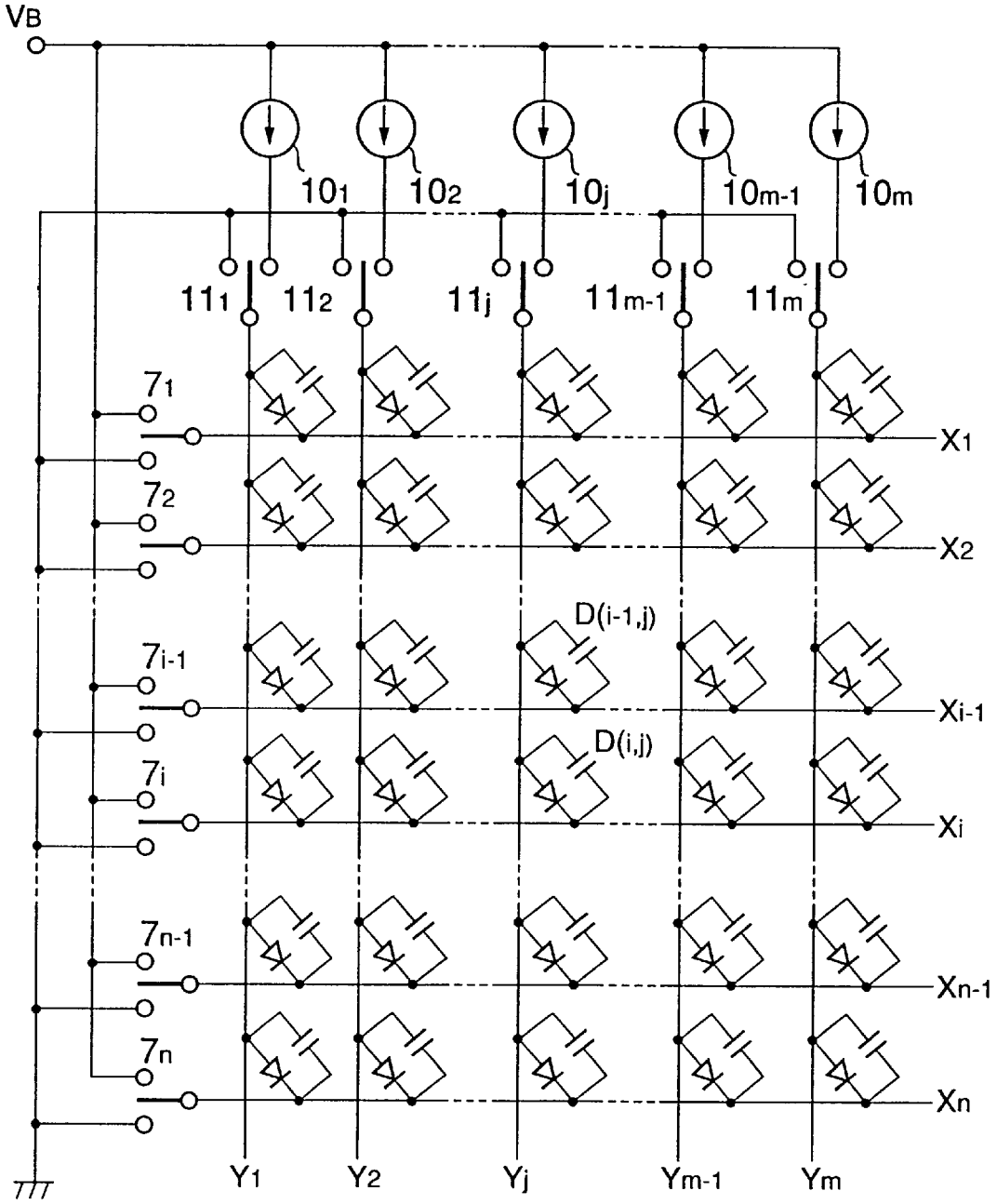
FIG.2 PRIOR ART
FIG. 2 is an equivalent circuit diagram of a drive circuit concerning an organic thin-film EL display device and a conventional driving method.
Figure 3:
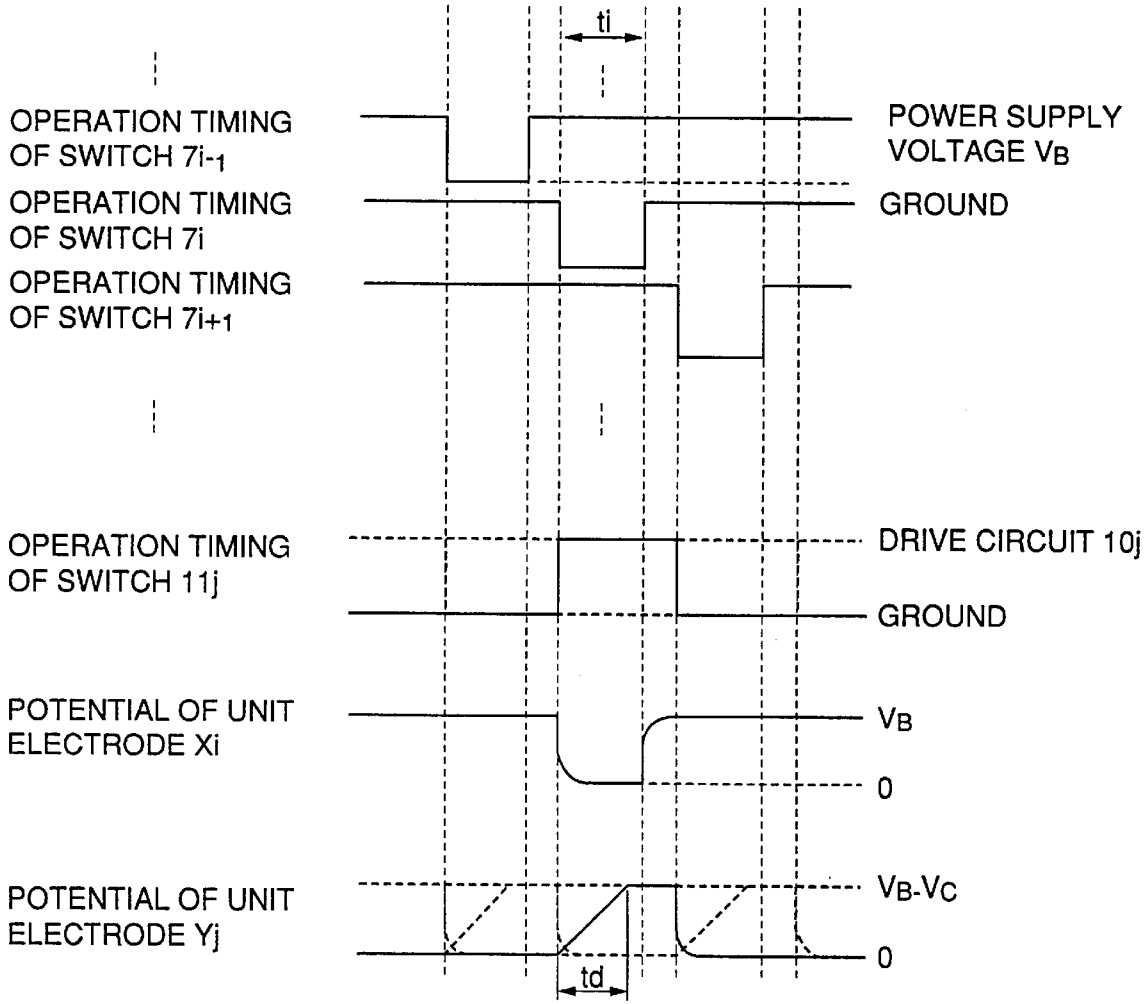
FIG.3 PRIOR ART
FIG. 3 is a timing chart showing the conventional drive method of the organic thin-film EL display device.
Figure 10:
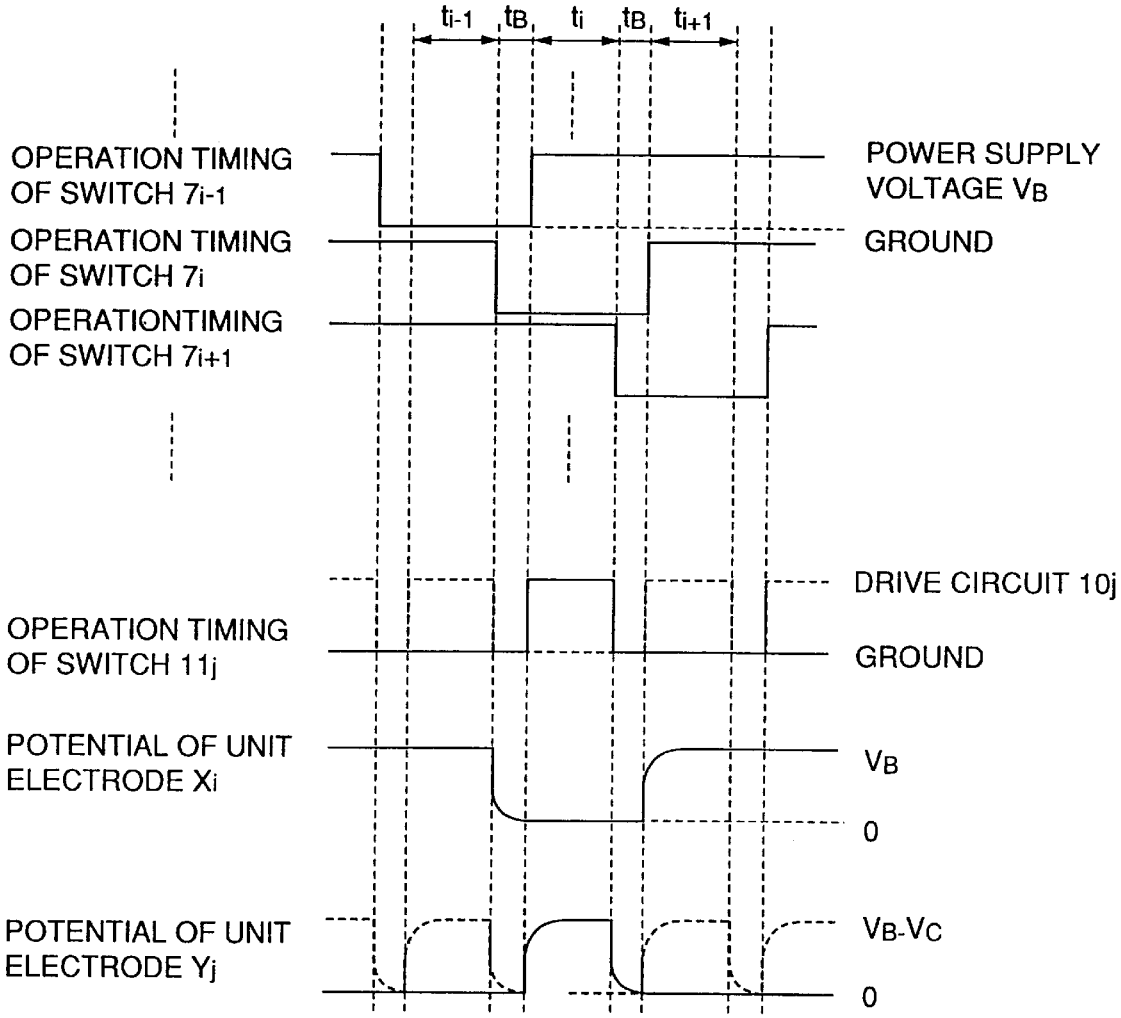
FIG. 10 is a timing chart showing a method of driving an organic thin-film EL display device according to the second embodiment of the present invention.

FIG. 10 is a timing chart showing a method of driving an organic thin-film EL display device according to the second embodiment of the present invention. FIG. 10 shows the switching operations of switches $\mathbf{7}_{i-1}$, $\mathbf{7}_i$, $\mathbf{7}_{i+1}$, and $\mathbf{11}_j$ of the arrangement similar to that of FIG. 2 showing the conventional drive circuit, and a change over time of the potential of each of a unit electrode $X_i$ of the scanning electrodes and of a unit electrode $Y_j$ of the data electrodes caused by the switching operations.

As an example, a case will be described wherein a pixel D(i, j) is selected to emit light.

In a time period $t_{i-1}$ during which a unit electrode $X_{i-1}$ of the scanning electrodes is selected by the switch $\mathbf{7}_{i-1}$ and connected to ground, the switch $\mathbf{11}_j$ connects the unit electrode $Y_j$ of the data electrodes to either the current supply means $\mathbf{10}_j$ or ground in accordance with display data. At this time, if the unit electrode $Y_j$ of the data electrodes is connected to ground, as indicated by solid lines, a zero bias is applied to a pixel D(i−1, j), and a reverse bias is applied to pixels D(1, j) to D(i−2, j), and pixels D(i, j) to D(n, j), to charge the parallel capacitances of these pixels in the reverse bias direction.

Then, a time period $t_B$ follows during which the switches $\mathbf{7}_1$ to $\mathbf{7}_n$ connect all the scanning electrodes $X_1$ to $X_n$ to the power supply voltage $V_B$. In the time period $t_B$, the switches $\mathbf{11}_1$ to $\mathbf{11}_m$ connect all the data electrodes $Y_1$ to $Y_m$ to ground. Hence, all the data electrodes $Y_1$ to $Y_m$ and all the scanning electrodes $X_1$ to $X_n$ are short-circuited. Accordingly, the storage capacitances of the pixels that have been charged in the reverse bias direction in the time period $t_{i-1}$ are discharged quickly regardless of the current supply means $\mathbf{10}_j$, and all the pixels are zero-biased.

Thereafter, during a time period $t_i$, when a unit electrode $X_i$ of the scanning electrodes is selected by a switch $\mathbf{7}_i$ and the switch $\mathbf{11}_j$ connects the unit electrode $Y_j$ of the data electrodes to the current supply means $\mathbf{10}_j$, the potential of the unit electrode $Y_j$ of the data electrodes increases immediately, and no delay occurs in emission of the pixel D(i, j).

Figure 11:
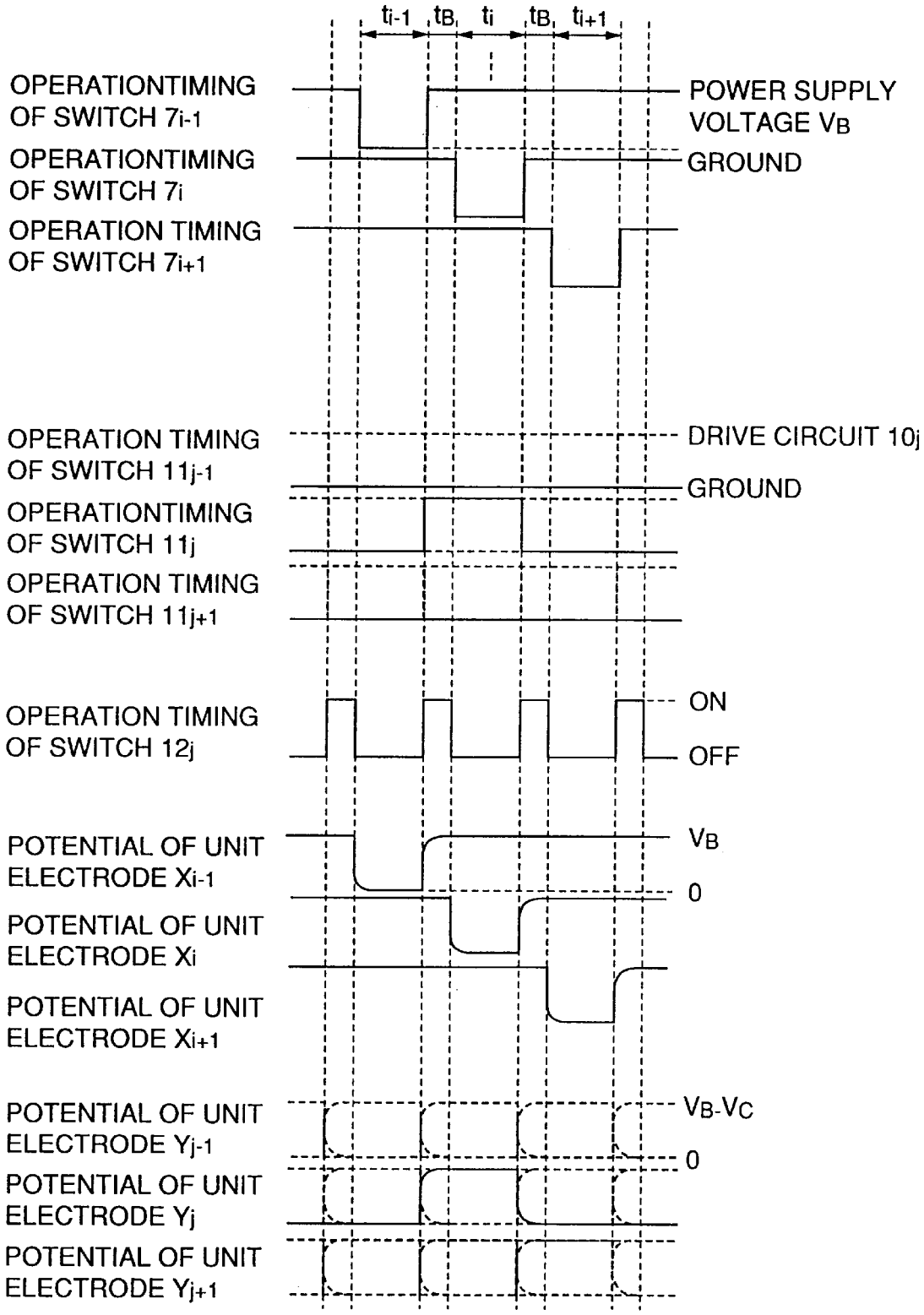
FIG. 11 is a timing chart showing a method of driving an organic thin-film EL display device according to the third embodiment of the present invention.

FIG. 11 is a timing chart showing a method of driving an organic thin-film EL display device according to the third embodiment of the present invention. FIG. 11 shows the operations of switches $\mathbf{7}_{i-1}$, $\mathbf{7}_i$, $\mathbf{7}_{i+1}$, $\mathbf{11}_j$, $\mathbf{11}_{j+1}$, and $\mathbf{12}_j$ in the arrangement similar to that shown in FIG. 4, and a change over time of the potential of the unit electrodes $X_{i-1}$, $X_i$, and $X_{i+1}$ of the scanning electrodes and of the unit electrodes $Y_{j-1}$, $Y_j$, and $Y_{j+1}$ of the data electrodes caused by the switching operations.

As an example, a case will be described wherein a pixel D(i, j) is selected to emit light.

In a time period $t_{i-1}$ during which the unit electrode $X_{i-1}$ of the scanning electrodes is selected by the switch $\mathbf{7}_{i-1}$ and connected to ground, the switches $\mathbf{11}_{j-1}$, $\mathbf{11}_j$, and $\mathbf{11}_{j+1}$ connect the unit electrodes $Y_{j-1}$, $Y_j$, and $Y_{j+1}$ of the corresponding data electrodes to either the corresponding current supply means $\mathbf{10}_{j-1}$, $Y_j$, and $\mathbf{10}_{j+1}$ or ground in accordance with display data. At this time, if the unit electrodes $Y_{j-1}$, $Y_j$, and $Y_{j+1}$ of the data electrodes are connected to ground, as indicated by solid lines, a zero bias is applied to pixels D(i−1, j−1), D(i−1, j), and D(i−1, j+1), and a reverse bias is applied to pixels D(1, j−1) to D(i−2, j−1), pixels D(1, j) to D(i−2, j), pixels D(1, j+1) to D(i−2, j+1), pixels D(i, j−1) to D(n, j−1), pixels D(i, j) to D(n, j), and pixels D(i, j+1) to D(n, j+1), to charge the parallel capacitances of these pixels in the reverse bias direction.

Then, a time period $t_B$ follows during which the switches $\mathbf{7}_1$ to $\mathbf{7}_n$ connect all the scanning electrodes $X_1$ to $X_n$ to the power supply voltage $V_B$. In the time period $t_B$, of the switches $\mathbf{11}_1$ to $\mathbf{11}_m$, only a switch concerning the unit electrode of a data electrode which should be selected in the time period $t_1$, during which the unit electrode $X_i$ of the scanning electrode is to be selected later, is connected to the corresponding current supply means. Simultaneously, the switches $\mathbf{12}_1$ to $\mathbf{12}_m$ are closed, and only the data electrode of the data electrodes $Y_1$ to $Y_m$ which is selected in the time period $t_i$, and all the scanning electrodes $X_1$ to $X_n$ are short-circuited. As an example, a case wherein only the unit electrode $Y_j$ of the data electrodes is selected in the time period $t_i$ was indicated by a solid line. Accordingly, the storage capacitance of only a pixel, of the pixels that have been charged in the reverse bias direction in the time period $t_{i-1}$, which should be selected in the period time $t_i$ is discharged quickly regardless of the current supply means $\mathbf{10}_j$, and is set at the zero bias.

In this manner, the charging/discharging loss, which occurs when a pixel which is not selected in the time period $t_i$ is reverse-biased again, can be decreased.

What is claimed is:

1. A method of driving an organic thin-film EL display device in which one or a plurality of organic multilayered thin films including at least one organic emission thin film are clamped in a matrix between a plurality of scanning electrodes comprising unit electrodes and a plurality of data electrodes comprising unit electrodes, at least one of said scanning electrodes and said data electrodes being translucent, wherein when a forward bias is applied between a selected unit electrode of said scanning electrodes and a selected unit electrode of said data electrodes to cause a selected pixel concerning both of said selected unit electrodes to emit light, and a reverse bias is applied between nonselected unit electrodes of said scanning electrodes and nonselected unit electrodes of said data electrodes, thereby preventing crosstalk caused by a semi-excited state of said nonselected pixels, all of said scanning electrodes and all of said data electrodes are short-circuited once, immediately before a predetermined unit electrode of said data electrode, which should be selected in accordance with selection of each of said unit electrodes of said scanning electrodes, is selected, to set all of said pixels at a zero bias.

2. A method of driving an organic thin-film EL display device in which one or a plurality of organic multilayered thin films including at least one organic emission thin film are clamped in a matrix between a plurality of unit electrodes comprising unit electrodes and a plurality of data electrodes comprising scanning electrodes, at least one of said scanning electrodes and said data electrodes being translucent, wherein when a forward bias is applied between a selected unit electrode of said scanning electrodes and a selected unit electrode of said data electrodes to cause a selected pixel concerning both of said selected unit electrodes to emit light, and a reverse bias is applied between nonselected unit electrodes of said scanning electrodes and nonselected unit electrodes of said data electrodes, thereby preventing crosstalk caused by a semi-excited state of said nonselected pixels, all of said scanning electrodes and a predetermined unit electrode of said data electrodes are short-circuited once, immediately before said predetermined unit electrode of said data electrode, which should be selected in accordance with selection of each of said unit electrodes of said scanning electrodes, is selected, to set pixels concerning all of said scanning electrodes and said predetermined unit electrode of said data electrodes at a zero bias.

3. An organic thin-film EL display device drive circuit for driving an organic thin-film EL display device in which one or a plurality of organic multilayered thin films including at least one organic emission thin film are clamped in a matrix between a plurality of scanning electrodes comprising unit electrodes and a plurality of data electrodes comprising unit electrodes, at least one of said scanning electrodes and said data electrodes being translucent, wherein when a forward bias is applied between a selected unit electrode of said scanning electrodes and a selected unit electrode of said data electrodes to cause a selected pixel concerning both of said selected unit electrodes to emit light, and a reverse bias is applied between nonselected unit electrodes of said scanning electrodes and nonselected unit electrodes of said data electrodes, thereby preventing crosstalk caused by a semi-excited state of said nonselected pixels, all of said scanning electrodes and all of said data electrodes are short-circuited once, immediately before a predetermined unit electrode of said data electrode, which should be selected in accordance with selection of each of said unit electrodes of said scanning electrodes, is selected, to set all of said pixels at a zero bias.

4. An organic thin-film EL display device drive circuit for driving an organic thin-film EL display device in which one or a plurality of organic multilayered thin films including at least one organic emission thin film are clamped in a matrix between a plurality of scanning electrodes comprising unit electrodes and a plurality of data electrodes comprising unit electrodes, at least one of said scanning electrodes and said data electrodes being translucent, wherein when a forward bias is applied between a selected unit electrode of said scanning electrodes and a selected unit electrode of said data electrodes to cause a selected pixel concerning both of said selected unit electrodes to emit light, and a reverse bias is applied between nonselected unit electrodes of said scanning electrodes and nonselected unit electrodes of said data electrodes, thereby preventing crosstalk caused by a semi-excited state of said nonselected pixels, all of said scanning electrodes and a predetermined unit electrode of said data electrodes are short-circuited once, immediately before said predetermined unit electrode of said data electrode, which should be selected in accordance with selection of each of said unit electrodes of said scanning electrodes, is selected, to set pixels concerning all of said scanning electrodes and said predetermined unit electrode of said data electrodes at a zero bias.

* * * * *